United States Patent [19]

Bassani et al.

[11] Patent Number: 4,674,562

[45] Date of Patent: Jun. 23, 1987

[54] PRESSURE-CONTROLLED HEAT PIPE

[75] Inventors: Carlo Bassani, Ispra; Claus A. O. Busse, Arolo Di Leggiuno, both of Italy

[73] Assignee: European Atomic Energy Community (Euratom), Luxembourg

[21] Appl. No.: 892,057

[22] Filed: Aug. 1, 1986

[30] Foreign Application Priority Data

Aug. 19, 1985 [LU] Luxembourg ..... 86046

[51] Int. Cl.[4] ..... F28D 15/00

[52] U.S. Cl. ..... 165/96; 165/104.27

[58] Field of Search ..... 165/32, 96, 104.26

[56] References Cited

U.S. PATENT DOCUMENTS

| | | | |
|---|---|---|---|
| 3,782,449 | 1/1974 | Busse et al. | 165/32 |
| 3,934,643 | 1/1976 | Laing | 165/32 |
| 4,136,733 | 1/1979 | Asselman et al. | 165/32 |
| 4,300,626 | 11/1981 | Busse et al. | 165/96 |

FOREIGN PATENT DOCUMENTS

| | | | |
|---|---|---|---|
| 929986 | 5/1982 | U.S.S.R. | 165/96 |
| 1017900 | 5/1983 | U.S.S.R. | 165/32 |

*Primary Examiner*—Albert W. Davis, Jr.

*Attorney, Agent, or Firm*—Stevens, Davis, Miller & Mosher

[57] ABSTRACT

The invention relates to a pressure-controlled heat pipe, consisting of a closed recipient containing a heat carrying medium, with a heat source where the heat carrying medium vaporizes, and with a heat drain formed by a cooling zone, an inert gas being intended to be fed under controllable pressure into the recipient at the upper end of the cooling zone. According to the invention, a displacement body (11) extends downwards from the upper end of the cooling zone, this body carrying at least in its upper part deflection sheets (12), which divide the interspace between the displacement body and the cooled wall of the cooling area into a plurality of interconnected volumes.

3 Claims, 2 Drawing Figures

PRESSURE-CONTROLLED HEAT PIPE

The invention relates to a pressure-controlled heat pipe comprising a closed recipient containing a heat carrying medium, with a heat source where the heat carrying medium vaporizes, and a heat drain constituted by a cooling zone, a non-condensable inert gas being intended to be fed into the recipient under controllable pressure at the upper end of the cooling zone.

Pressure-controlled heat pipes are for example known from the periodical "Wärme- und Stoffübertragung", vol. 19, 1985, pages 67 to 71. The temperature of such heat pipes is influenced by the size of an inert gas column in the cooling zone. If the temperature of the heat furnace is to be raised, the inert gas pressure is increased, by which the cooling surface which can be reached by the carrying medium, is reduced.

It has been found, especially for low operation pressures, that a mist zone develops in the cooling zone at the interface between the vaporized heat carrying medium and the inert gas and that vapor droplets can move far into the area of the inert gas column. It can then happen that the vapor not only condenses at the substantially cooler wall in the area of the inert gas column, but is even deposited as a solid material. This effect is still increased by the natural convection of the inert gas, which mounts in the axial area of the cooling zone and drops down again in the cooler wall area.

This danger is particularly present during a controlled transition of the heat pipe to a lower temperature, because then a part of the inert gas is drawn off.

It is the object of the invention to improve a heat pipe such as described above in such a way that deposits of solid materials in the cooling zone cannot happen any more, even in cases when the pressure of the inert gas is changed quickly for control reasons.

This object is achieved according to the invention by the fact that a thermally conductive displacement body extends downwards from the upper part of the cooling zone along its central area and that this displacement body carries at least in its upper part deflection sheets which divide the space between the cooled wall and the displacement body into a plurality of interconnected volumes. Preferably, these deflection sheets are helical ribs.

The function of the helical ribs is, on the one hand, to lengthen the way of the condensate droplets on their way up, so that they do not reach any more the coldest area of the cooling wall, and on the other hand, to hinder the convection flow of the inert gas in the axial area of the cooling zone.

The displacement body contributes to the solution of the problem attacked by the invention in that, on the one hand, it occupies the axial area of the cooling zone and thus deflects at an early moment the condensate droplets in the direction of the cooled wall, and, on the other hand, by the fact that it holds the area of the cooling zone above the vapor zone at a high temperature, at which solid deposits are impossible.

Preferably, the helical ribs have a roof-shaped inclination to the outside, so that condensate can flow off by gravity towards the chimney wall.

It is not necessary, but for manufacturing reasons it is useful, to form the helical ribs as single-threaded screw. It would for example also be possible to interrupt the rib structure and to form at least two successive single-threaded screws, one of which could have a right-handed helix and the other a left-handed helix, or one of which could have a larger screw-thread than the other.

The invention will now be described in detail with respect to a preferred embodiment and with reference to the drawings.

Figure 1:
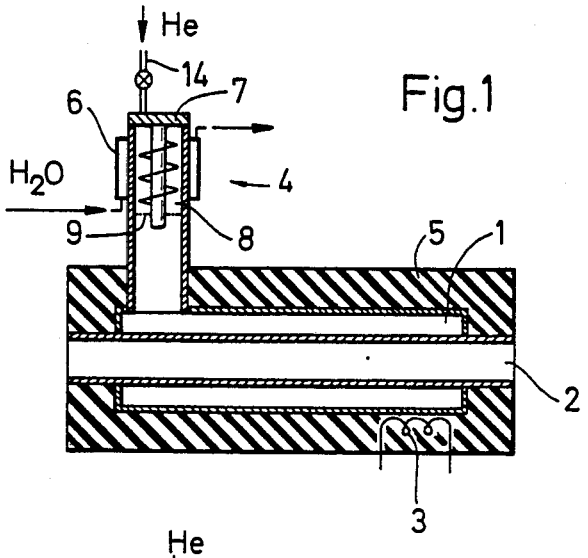
FIG. 1 shows a sectional view of a heat pipe furnace with a pressure controlled heat pipe according to the invention.

The heat furnace shown in FIG. 1 consists of a double-walled horizontal heat pipe 1, which coaxially surrounds a furnace channel 2. In the area between the two walls of the heat pipe 1, there is a heat carrying medium, for example water, caesium or sodium, which vaporizes at a heat source 3 and condensates at a heat drain 4. The heat source is for example a resistance heating which is inserted into an insulation 5 surrounding the heat pipe 1 and which heats the heat pipe from the outside. The heat drain 4 is formed by a chimney which is connected to the heat pipe and protrudes at the top from the insulation 5. The outer wall of the chimney is cooled in its upper area, for example by means of a water cooling device 6. An inert gas duct 14, for example a helium duct, by which the uppermost area of the chimney can be supplied with an inert has column 8, ends at the cover 7 of the chimney. By an appropriate choice of the helium pressure, the interface layer 9 between the vaporized heat carrying medium in the heat pipe 1 and the inert gas column can be displaced vertically, so that a more or less large area of the cooled wall can become effective as a heat drain for the heat carrying medium. The helium supply is carried out by a control circuit (not shown) which controls the temperature in the furnace 2 close to a nominal temperature.

Figure 2:
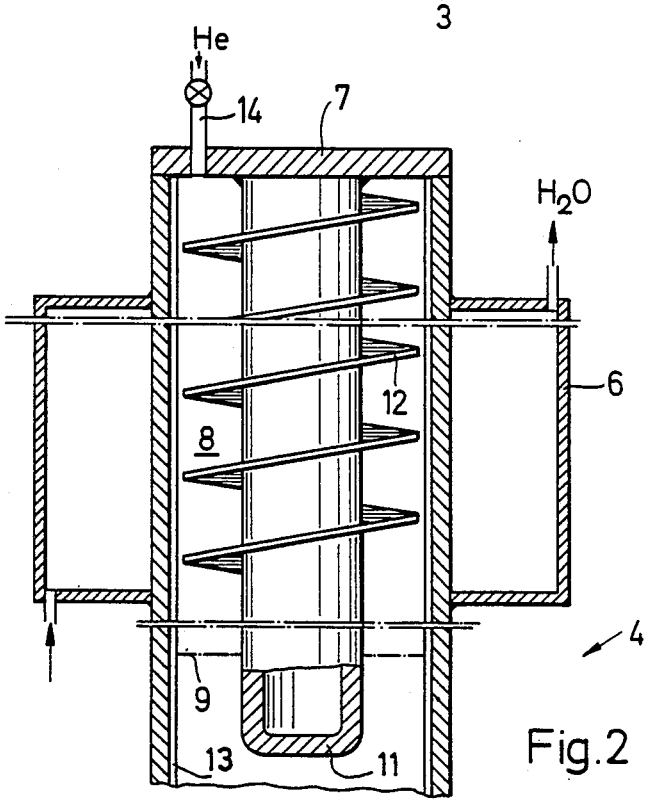
FIG. 2 shows, at a larger scale, a detail of FIG. 1.

FIG. 2 shows at a larger scale the upper end of the chimney 4 with the water cooling device 6 and the interface layer 9 between the inert gas column 8 and the vapor of the heat carrying medium. A displacement body 11 penetrates axially into this chimney from above and through a cover 7, this displacement body consisting of a thermally conductive metal. The displacement body extends below the minimum level of the interface layer 9, so that its tip is always immerged in the vaporized heat carrying medium. The upper half of this displacement body carries helical ribs 12, which almost reach the wall of the chimney which is supplied with capillar grooves 13.

The chimney insert according to the invention deflects the droplets sidewards and reduces the convection effect, as the vapor particles are quickly deviated from the axial area to the outside in the direction of the cooled chimney wall. At the same time, the displacement body 11, the lower end of which is immerged in the hot vapor of the heat carrying medium, holds the helical ribs at a high temperature with respect to the wall, so that there is no risk of solid deposits, which might render the furnace unusable. These influences of the chimney insert according to the invention thus promote the stability under normal conditions.

When working conditions are voluntarily changed, in particular when the furnace temperature is lowered by reducing the inert gas column, the danger of condensate droplets penetrating into the upper areas of the chimney is also reduced, whereas without the insert according to the invention, in this case, condensate droplets can even penetrate into the helium duct 14.

Finally, the chimney insert according to the invention brings security advantages in the case of an accident, when the helium duct breaks. In this case, the rising vapor flow must run through all the helix loops before it can escape through the broken helium duct. Thus, the insert acts as a condensation trap and prevents the escape of the heat carrying medium.

The invention is not limited to the embodiment described in detail. Thus, the heat pipe can have another form than that of a double-walled coaxial pipe. The heat pipe need not lie horizontally, but can also be inclined or stand up vertically. While it is important for a horizontal installation of the heat pipe that all inner walls are provided with capillar structures, so that all the walls are constantly wetted by liquid heat carrying medium, in a vertical installation, the wetting could be carried out without the capillar structures only by means of gravity. The chimney could also be mounted on the heat pipe in an inclined position, provided that it is positioned above the heat pipe.

The helical ribs can be replaced by elements with a different shape, for example by deflection tools of pagoda shape, which act as an obstacle for the vapor flow and which also divide the annular zone between the displacement body and the cooled wall into a plurality of interconnected partial volumes.

Depending on the admissible pressure losses along the cooling zone, the helical screw can be shaped as a screw with several threads, which can have a larger pitch than a one-threaded screw without increasing the partial volumes.

What is claimed is:

1. A pressure-controlled heat pipe consisting of a closed recipient containing a heat carrying medium, with a heat source where the heat carrying medium vaporizes, and a heat drain in the form of a cooling zone, a non-condensable inert gas being intended to be fed under controllable pressure into the recipient at the upper end of the cooling zone, characterized in that a thermally conductive displacement body (11) extends downwards from the upper end of the cooling zone along the central area of said zone, and that this displacement body carries at least in its upper part deflection sheets (12), which divide the interspace between the displacement body and the cooled wall of this zone into a plurality of interconnected volumes.

2. A heat pipe according to claim 1, characterized in that the deflection sheets have the form of helical ribs (12), which extend into the vicinity of the cooled wall.

3. A heat pipe according to claim 2, characterized in that the helical ribs (12) have a roof-shaped inclination to the outside.

* * * * *